US005877503A

United States Patent [19]

Neriishi

[11] Patent Number: 5,877,503

[45] Date of Patent: Mar. 2, 1999

[54] RADIATION IMAGE STORAGE PANEL

[75] Inventor: Keiko Neriishi, Kanagawa, Japan

[73] Assignee: Fuji Photo Film Co., Ltd., Kanagawa, Japan

[21] Appl. No.: 545,531

[22] Filed: Oct. 19, 1995

[30] Foreign Application Priority Data

Oct. 19, 1994 [JP] Japan ..... 6-279885

[51] Int. Cl.[6] ..... G21K 4/00

[52] U.S. Cl. ..... 250/484.4

[58] Field of Search ..... 250/484.4, 584, 250/585, 586

[56] References Cited

U.S. PATENT DOCUMENTS

| | | | |
|---|---|---|---|
| 4,517,463 | 5/1985 | Gasiot et al. | 250/585 |
| 4,535,237 | 8/1985 | Takahashi et al. | 250/585 |
| 4,535,238 | 8/1985 | Takahashi et al. | 250/585 |
| 4,574,102 | 3/1986 | Arakawa et al. | 250/484.4 X |
| 4,800,136 | 1/1989 | Arakawa et al. | 250/484.4 X |
| 4,948,696 | 8/1990 | Nakamura et al. | 250/484.4 X |

*Primary Examiner*—Edward J. Glick

*Attorney, Agent, or Firm*—Sixbey, Friedman, Leedom & Ferguson, P.C.; Gerald J. Ferguson, Jr.

[57] ABSTRACT

An improvement of a radiation image storage panel comprising a stimulable phosphor layer which comprises stimulable phosphor particles, a binder and a colorant resides in that a weight ratio of binder to phosphor particles and concentration of coloring are varied along the depth of the phosphor layer in such manner that a mean value of a weight ratio of binder to phosphor particles within ¼ of the depth of the phosphor layer from one surface thereof is larger than a mean value of a weight ratio of binder to phosphor particles between ¼ and ¾ of the depth of the phosphor layer, and a mean value of a weight ratio of colorant to phosphor particles within ¼ of the depth of the phosphor layer from the surface is smaller than a mean value of the weight ratio of colorant to phosphor particles between ¼ and ¾ of the depth of the phosphor layer from the surface.

3 Claims, 4 Drawing Sheets

RADIATION IMAGE STORAGE PANEL

FIELD OF THE INVENTION

The present invention relates to a radiation image storage panel utilizing a stimulable phosphor, and a radiation image recording and reproducing method employing the radiation image storage panel. The invention is specifically directed to a radiation image storage panel which gives a radiation image of a high sharpness and is favorably employable in mammography.

BACKGROUND OF THE INVENTION

A radiation image recording and reproducing method utilizing a stimulable phosphor as described, for instance, in U.S. Pat. No. 4,239,968, is now practically employed. In the method, a radiation image storage panel comprising a stimulable phosphor in the form of particles (i.e., stimulable phosphor sheet) is employed, and the method involves the steps of causing the stimulable phosphor of the storage panel to absorb energy of radiation having passed through an object or having radiated from an object; sequentially exciting the stimulable phosphor with an electromagnetic wave such as visible light or infrared rays (hereinafter referred to as "stimulating rays") to release the radiation energy stored in the phosphor as light emission (i.e., stimulated emission); photoelectrically detecting the emitted light to obtain electric signals; and reproducing the radiation image of the object as a visible image from the electric signals.

In the radiation image recording and reproducing method, a radiation image is obtainable with a sufficient amount of information by applying a radiation to an object at a considerably smaller dose, as compared with a conventional radiography using a combination of a radiographic film and radiographic intensifying screen. Further, the radiation image recording and reproducing method using a stimulable phosphor is of greater value especially when the method is employed for medical diagnosis.

The radiation image storage panel employed in the above-described method comprises a stimulable phosphor layer which is optionally provided on a support. Further, a transparent layer of a polymer material is generally provided on the free surface (e.g., surface not facing the support) of the phosphor layer to keep the phosphor layer from chemical deterioration or physical shock.

The phosphor layer generally comprises a binder and a stimulable phosphor (in the form of particles) dispersed therein. The stimulable phosphor emits light (that is, given stimulated emission) when it is exposed to radiation such as X-rays and then excited with stimulating rays. Accordingly, the radiation having passed through an object or radiated from an object is absorbed by the stimulable phosphor layer of the storage panel in an amount proportional to the applied radiation dose, and a radiation image of the object is produced on the storage panel in the form of a radiation energy-stored image. The radiation energy-stored image is released as stimulated emission by sequentially irradiating the storage panel with stimulating rays. The stimulated emission is then photoelectrically detected to give a series of electric signals, so as to reproduce a visible image from the electric signals.

The radiation image recording and reproducing method is generally performed in a united radiation image recording and reading apparatus which comprises recording means (for applying a radiation having an image information to the radiation image storage panel to record the radiation image on the storage panel); reading means (for irradiating the stimulating rays to the storage panel having the radiation image to produce stimulated emission from the storage panel and photoelectrically reading the stimulated emission); erasing means (for applying an erasing light to the storage panel after the reading step is complete to remove a radiation image remaining in the storage panel); and transfer system (which is arranged between these means, for transferring the storage panel from one means to another means in predetermined order). Alternatively, the radiation image recording and reading apparatus may comprise two separate apparatuses, that is, a radiation image recording apparatus and a radiation image reading apparatus equipped with erasing means.

In any of the radiation image recording and reproducing systems, the radiation image storage panel is repeatedly employed after the remaining radiation image is erased.

In a representative radiation image reproducing method, the stimulable phosphor particles are sequentially excited by applying the stimulating rays to one surface of the radiation image storage panel, and then the produced light emission is photoelectrically detected from the surface to which the stimulating rays are applied.

In the radiation image recording and reproducing method, it is naturally desired to give a radiation image of good quality (such as a high sharpness and a high graininess).

U.S. Pat. No. 4,394,581 describes coloring of the stimulable phosphor layer with a colorant which is capable of absorbing stimulating rays, so that a radiation image of a high sharpness and a good graininess can be produced.

U.S. Pat. No. 4,574,102 describes varying of a weight ratio of binder to stimulable phosphor particles along the depth of the stimulable phosphor layer, so that a radiation image of a high sharpness can be obtained.

Although the radiation image storage panel is preferred to have high quality in all of sensitivity, sharpness, graininess and the like, it is not easy to prepare a radiation image storage panel which satisfies all of the preferred features. Therefore, a radiation image storage panel is generally designed and produced to have sufficiently high quality in the nature specifically required in radiography for the specific purpose. That is because, in medical diagnosis, a variety of portions of human body are examined, and a variety of requirements are raised to the nature and quality of radiation images depending upon the portions to be examined.

In radiography, it is known that mammography requires a radiation image of an extremely high sharpness so as to easily diagnose mammary cancer.

SUMMARY OF THE INVENTION

Accordingly, it is an object of the present invention to provide a radiation image storage panel which is favorably employable particularly in mammography.

Another object of the invention is to provide a radiation image recording and reproducing method which is favorably employable particularly in mammography.

The present invention resides in a radiation image storage panel comprising a stimulable phosphor layer which comprises stimulable phosphor particles and a binder and is colored with a colorant so as to absorb a portion of stimulating rays, wherein a weight ratio of binder to phosphor particles and concentration of coloring are varied along the depth of the phosphor layer (i.e., direction of thickness of the phosphor layer) in such manner that a mean value of a weight ratio of binder to phosphor particles within ¼ of the depth of the phosphor layer from one surface thereof is larger than a mean value of a weight ratio of binder to phosphor particles between ¼ and ¾ of the depth of the phosphor layer, and a mean value of a weight ratio of colorant to phosphor particles within ¼ of the depth of the phosphor layer from said surface is smaller than a mean value of the weight ratio of colorant to phosphor particles between ¼ and 4/4 (i.e., region farther than the ¼ position) of the depth of the phosphor layer from said surface.

The invention also resides in a radiation image recording and reproducing method comprising the steps of:

applying a radiation having passed through an object or having radiated from an object to the above-mentioned radiation image storage panel which has a stimulable phosphor layer whose binder-to-phosphor particles ratio by weight is relatively large on one side and whose colorant-to-phosphor particles ratio by weight is relatively small on that side, so as to cause the stimulable phosphor particles of the panel to absorb energy of the radiation;

sequentially exciting the stimulable phosphor particles by applying stimulating rays to the surface of the stimulable phosphor layer on the side of a relatively large binder-to-phosphor particles ratio to release the energy of radiation stored in the phosphor particles as light emission;

photoelectrically detecting the light emission from the surface to which the stimulating rays are applied to obtain electric signals; and reproducing a radiation image of the object as a visible image from the electric signals.

In the above-mentioned radiation image storage panel, the weight ratio of binder to phosphor particles preferably has the minimum value in the area between ¼ and 4/4 of the depth of the phosphor layer from the surface on the side of a relatively large binder-to-phosphor particles ratio. Further, the weight ratio of colorant to phosphor particles preferably has the maximum value in the area between ¼ and 4/4 of the depth of the phosphor layer from the surface on the side of a relatively large binder-to-phosphor particles ratio.

DETAILED DESCRIPTION OF THE INVENTION

Figure 1:
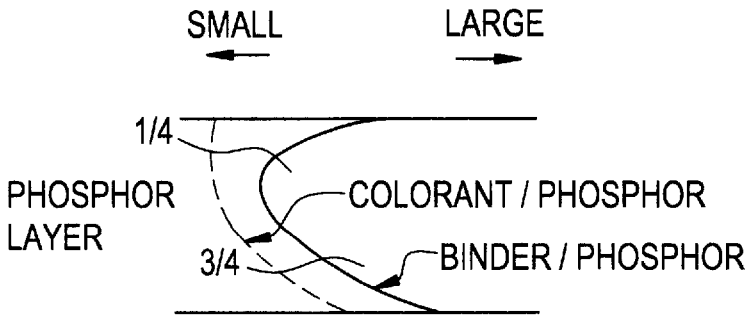
FIG. 1 shows a schematic view of distributions of the binder-to-phosphor particles ratio by weight and the colorant-to-phosphor particles ratio by weight in the radiation image storage panel of the invention which is prepared in Example 1.

The above-mentioned radiation image storage panel of the invention can be preferably prepared by one of the following two processes.

A process which comprises the steps of:

coating a first coating mixture of the stimulable phosphor particles, binder and colorant in an organic liquid medium on one temporary support and drying the coated mixture to give a first stimulable phosphor sheet on the temporary support;

coating a second coating mixture of the stimulable phosphor particles and binder in an organic liquid medium on another temporary support, said coating mixture possibly containing the colorant, provided that a weight ratio of colorant to phosphor particles in the second coating mixture is less than that of the first coating mixture, and drying the coated mixture to give a second stimulable phosphor sheet on the temporary support;

removing each of the first and second stimulable phosphor sheets from the temporary support; and combining the first stimulable phosphor sheet and the second stimulable phosphor sheet in such manner that the surface of the first stimulable phosphor sheet with which the phosphor sheet has been supported on the temporary support faces the surface of the second stimulable phosphor sheet with which the phosphor sheet has been supported on the temporary support.

A process which comprises the steps of:

coating a first coating mixture of the stimulable phosphor particles, binder and colorant in an organic liquid medium on one temporary support and drying the coated mixture to give a first stimulable phosphor sheet on the temporary support;

coating a second coating mixture of the stimulable phosphor particles and binder in an organic liquid medium on another temporary support, said coating mixture possibly containing the colorant, provided that a weight ratio of colorant to phosphor particles in the second coating mixture is less than that of the first coating mixture, and drying the coated mixture to give a second stimulable phosphor sheet on the temporary support;

coating a third coating mixture of the stimulable phosphor particles and binder in an organic liquid medium on other temporary support, said coating mixture possibly containing the colorant, provided that a weight ratio of colorant to phosphor particles in the third coating mixture is less than that of the first coating mixture, and drying the coated mixture to give a third stimulable phosphor sheet on the temporary support;

removing each of the first, second and third stimulable phosphor sheets from the temporary support; and combining the first stimulable phosphor sheet, the second stimulable phosphor sheet, and the third stimulable phosphor sheet in such manner that the surface of the first stimulable phosphor sheet with which the phosphor sheet has been supported on the temporary support faces the surface of the second stimulable phosphor sheet with which the phosphor sheet has been supported on the temporary support, and the surface of the third stimulable phosphor sheet with which the phosphor sheet has been supported on the temporary support faces another surface of the first stimulable phosphor sheet.

The radiation image storage panel can be also prepared by a process which comprises coating two coating mixtures of the phosphor layer by a simultaneous double coating method and then drying the coated layers.

The stimulable phosphor gives a stimulated emission when it is irradiated with stimulating rays after it is exposed to radiation. In the preferred radiation image storage panel, a stimulable phosphor giving a stimulated emission of a wavelength in the range of 300 to 500 nm when it is irradiated with stimulating rays of a wavelength in the range of 400 to 900 nm is employed. Examples of the preferred stimulable phosphors include divalent europium activated alkaline earth metal halide phosphors and cerium activated alkaline earth metal halide phosphors. Both stimulable phosphors favorably give the stimulated emission of high luminance. However, the stimulable phosphors employable in the radiation image storage panel of the invention are not limited to the above-mentioned preferred stimulable phosphors, and any of the known stimulable phosphors can be employed.

Examples of the binders for preparing the stimulable phosphor layer include various natural polymers such as proteins (e.g., gelatin), and polysaccharides (e.g., dextran), and various synthetic polymers such as polyvinyl butyral, polyvinyl acetate, ethylcellulose, vinylidenevinyl chloride copolymer, vinyl chloride-vinyl acetate copolymer, nitrocellulose, cellulose acetate butylate, polyvinyl alcohol, linear polyester, polystyrene, epoxy resin, polyacrylate, polymethacrylate, and polyurethane. These polymers can be employed singly or in combination. The polymers can be crosslinked in the stimulable phosphor layer using a crosslinking agent.

The colorant (i.e., coloring material or coloring agent, which may be a dye or a pigment) employable for the coloring of the stimulable phosphor layer can be an organic or inorganic colorant which has a body color ranging from blue to green.

Examples of the organic colorants having a body color ranging from blue to green include Zapon Fast Blue 3G (available from Hoechst AG), Estrol Brill Blue N-3RL (availble from Sumitomo Chemical Co., Ltd.), D & C Blue No. 1 (available from National Aniline AG), Spirit Blue (available from Hodogaya Chemical Co., Ltd.), Oil Blue No. 603 (available from Orient Co., Ltd.), Kiton Blue A (available from Ciba-Geigy), Aizen Cathilon Blue GLH (available from Hodogaya Chemical Co., Ltd.), Lake Blue A, F, H (available from Kyowa Chemical Co., Ltd.), Rodarin Blue 6GX (available from Hodogaya Chemical Co., Ltd.), Primocyanine 6GX (available from Inahata Sangyo Co., Ltd.), Brillacid Green 6BH (available from Hodogaya Chemical Co., Ltd.), Cyanine Blue BNRS (available from Toyo Ink Mfg. Co., Ltd.), and Lionol Blue SL (available from Toyo Ink Mfg. Co., Ltd.). Examples of the inorganic colorants having a body color ranging from blue to green include ultramarine (i.e., ultramarine blue), cobalt blue, cerulean blue, chromium oxide, and $TiO_2$—ZnO—CoO—NiO.

The coating mixture can be prepared by adding the stimulable phosphor particles, binder and colorant to an organic liquid medium (i.e., solvent) and sufficiently mixing the composition to disperse the phosphor particles and the colorant in a binder solution.

Examples of the organic liquid mediums include lower alcohols such as methanol, ethanol, n-propanol and butanol, chlorine-atom containing hydrocarbons such as methylene chloride and ethylene chloride, ketones such as acetone, methyl ethyl ketone, and methyl isobutyl ketone, esters of lower aliphatic acids and lower alcohols such as methyl acetate, ethyl acetate, and butyl acetate, ethers such as dioxane, ethylene glycol monoethyl ether, and ethylene glycol monomethyl ether. These liquid mediums can be employed singly or in combination.

The binder and the stimulable phosphor particles can be mixed in a ratio by weight of 1:1 to 1:100 (binder: phosphor), but depends on the natures of the phosphor particles, the binder, and the radiation image storage panel to be prepared The weight ratio preferably is 1:8 to 1:40, and more preferably is 1:8 to 1:30.

The colorant can be used in such an amount that the incorporated colorant can absorb the desired amount of stimulating rays so as to give a radiation image of a high sharpness.

The coating mixture can contain a dispersant and a plasticizer so as to enhance dispersability of the insoluble components in the binder solution and to increase binding force between the binder and the phosphor particles in the obtained phosphor sheet.

The coating mixture is first coated uniformly on a temporary support having a plain surface (such as a plastic sheet, a glass plate, or a metal plate) to form a coated layer. The coating can be done using a known coating device such as doctor blade, roll coater or knife coater. The coated layer is gradually heated to dryness, so that a stimulable phosphor layer is produced. The stimulable phosphor layer is then peeled off from the temporary support to give the desired stimulable phosphor sheet.

The stimulable phosphor sheet generally has a thickness of 20 $\mu$m to 1 mm, preferably 50 to 500 $\mu$m, more preferably 100 to 400 $\mu$m.

In the procedure of heating and drying the coated layer, the solvent (i.e., liquid medium) elevates and evaporates from the upper surface of the coated layer. Along with this movement of the solvent, the binder also moves upward. Therefore, the weight ratio of binder-to-phosphor particles (binder/phosphor particles) increases in the vicinity of the upper surface of the dried layer, and decreases at the bottom. The colorant such as a dye or a pigment also moves in conjunction with the binder so as to preferentially gather on the upper side. Accordingly, in the resulting phosphor sheet, the binder-to-phosphor ratio as well as the colorant-to-phosphor ratio are higher on the upper side (particularly, near the upper surface) than on the lower side.

The radiation image storage panel of the invention can be prepared by producing two colored stimulable phosphor sheets (in which two phosphor sheets can contain a binder, phosphor particles and a colorant in amounts differing from each other) in the above manner and then combining the two phosphor sheets in such manner that one sheet is turned upside down and another sheet is placed thereon. Alternatively, one stimulable phosphor sheet may not contain a colorant. In this case, the non-colored phosphor sheet is placed on the colored phosphor sheet which is beforehand turned upside down. The non-colored phosphor sheet can be replaced with a weakly or slightly colored phosphor sheet.

The resulting composite is placed under pressure to give a radiation image storage panel.

The radiation image storage panel of the invention can be prepared using three stimulable phosphor sheets, for instance, in the following manner.

One colored stimulable phosphor sheet and two non-colored (or weakly colored) stimulable phosphor sheets are prepared. One non-colored (or weakly colored) phosphor sheet is turned upside down, and the colored phosphor sheet is placed thereon. Finally, another non-colored (or weakly colored) phosphor sheet is placed on the colored phosphor sheet to give a radiation image storage panel composed of the three phosphor sheets. The process of using three phosphor sheets are described in more detain in Example 3 given hereinafter.

As is described before, the radiation image storage panel is generally employed repeatedly in cycle. Accordingly, the stimulable phosphor sheet preferably has a transparent protective layer of a thickness of less than 30 μm on its surface. The protective layer can be made of cellulose acetate, nitrocellulose, polymethyl methacrylate, polyvinyl butyral, polyvinyl formal, polycarbonate, polyvinyl acetate, vinyl chloride-vinyl acetate copolymer, or fluororesin. The protective layer is preferably made of a fluororesin (namely, a fluorine atom-containing resin). Also employable for the preparation of the protective layer is polyethylene terephthalate, polyethylene naphthalate, polyimide, polyethylene, vinylidene chloride, or polyamide. The protective layer can be prepared directly on the phosphor layer using a coating solution. Also employable is a beforehand prepared transparent plastic film.

Examples embodying the present invention and comparison examples are given below.

EXAMPLE 1

To methyl ethyl ketone was added to 200 g of divalent europium activated barium fluorobromide ($BaFBr_{0.9}I_{0.1}:Eu^{2+}$) stimulable phosphor particles, 40 g of a solution of a polyurethane resin (Desmolack 74125, product of Sumitomo Bayer Urethane, Co., Ltd.) in methyl ethyl ketone (20 wt %), 2 g of Bisphenol A type epoxy resin (Epikote 1004, product of Yuka Shell Epoxy Co., Ltd.), and 100 mg of Zapon Fast Blue 3G (organic blue colorant, product of Hoechst AG). The resulting mixture was stirred by a propeller mixer to give a dispersion containing binder and phosphor particles in the ratio of 1:20 (weight ratio) and colorant.

The obtained dispersion was evenly coated using a doctor blade over a polyethylene terephthalate sheet (temporary support having a releasing layer, thickness: 250 μm) fixed on a glass plate with an adhesive. The coated sheet together with the glass plate was placed in an oven and heated gradually from 25° C. to 100° C. to dry the coated layer. Thus, a stimulable phosphor layer having a thickness of 120 μm was formed on the temporary support. The phosphor layer was then separated from the support to give a colored stimulable phosphor sheet (Phosphor sheet A).

Separately, the coating dispersion was prepared in the same manner as above except that the amount of the stimulable phosphor was changed to 300 g and no colorant was used. The obtained dispersion was coated on a temporary support and dried in the same manner as above to give a stimulable phosphor layer having a thickness of 60 μm on the support. The phosphor layer was then separated from the support to give a non-colored stimulable phosphor sheet (Phosphor sheet B).

Phosphor sheet A was turned upside down, and Phosphor sheet B was placed thereon. The resulting laminate of Phosphor sheet B—Phosphor sheet A (turned upside down) from the upper side was compressed under heating (at 60° C., temperature higher than a softening point of the binder) to give a phosphor sheet composite of the invention in which the lower Phosphor sheet A and the upper Phosphor sheet B adhered to each other at their bottom surfaces (the bottom surface means the surface which has in contact with the temporary support prior to the separation of the phosphor sheet).

The resulting phosphor sheet composite was cut to observe its section by an optical microscope utilizing a combination of a red light and an X-ray analyzer. It was confirmed that the components were distributed in the manner as schematically illustrated in FIG. 1. In FIG. 1, the upper side is to receive application of stimulating rays, and the reading of the stimulated emission is made from the same upper side.

To the bottom of the phosphor sheet composite was combined a poluyethylene terephthalate sheet (support, thickness: 300 μm) with a polyester resin adhesive. On the upper side of the phosphor sheet composite was coated a coating solution comprising 70 g of a fluororesin (fluoroolefin-vinyl ether copolymer, Lumiflon LF504X, product of Asahi Glass Works Co., Ltd.), 12 g of a cross-linking agent (isocyanate, Olester NP38-70S, 70% solution, product of Mitsui-Toatsu Chemical Industry Co., Ltd.), and 0.5 g of a lubricant (alcohol-modified silicone, X-22-2809, 66% solution, product of Shin-Etsu Chemical Industry Co., Ltd.) in a mixture of methyl ethyl ketone and cyclohexane (2:8) and having a viscosity of 0.2–0.3 PS, using a doctor blade. The coated layer was heated to 120° C. for 30 min., to cure the layer to form a protective layer on the phosphor sheet composite.

Thus, a radiation image storage panel according to the invention was prepared.

EXAMPLE 2

A coating dispersion for preparing a colored stimulable phosphor sheet was prepared in the same manner as in Example 1 except for employing 400 g of the stimulable phosphor particles and 200 mg of the colorant. The obtained dispersion was coated on a temporary support and dried in the same manner as in Example 1 to give a stimulable phosphor layer having a thickness of 120 μm on the support. The phosphor layer was then separated from the support to give a colored stimulable phosphor sheet (Phosphor sheet C).

The obtained Phosphor sheet C was turned upside down, and Phosphor sheet B (non-colored stimulable phosphor sheet) having been prepared in the same manner as in Example 1 was placed thereon. The resulting laminate comprising Phosphor sheet B—Phosphor sheet C (turned upside down) from the upper side was compressed under heating in the same manner as in Example 1 to give a phosphor sheet composite of the invention in which the lower Phosphor sheet C and the upper Phosphor sheet B adhered to each other at their bottom surfaces.

Figure 2:
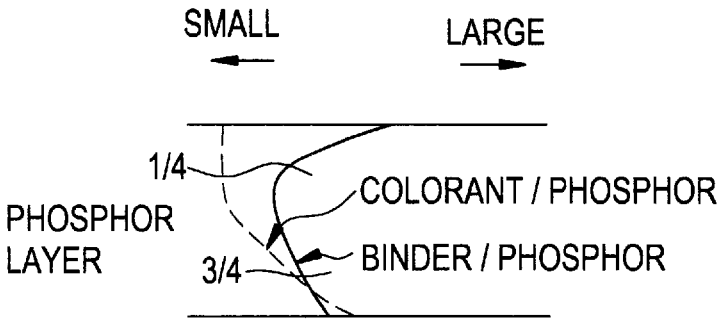
FIG. 2 shows a schematic view of distributions of the binder-to-phosphor particles ratio by weight and the colorant-to-phosphor particles ratio by weight in the radiation image storage panel of the invention which is prepared in Example 2.

The resulting phosphor sheet composite was cut to observe its section by an optical microscope in the same manner as in Example 1. It was confirmed that the components were distributed in the manner as schematically illustrated in FIG. 2. In FIG. 2, the upper side is to receive application of stimulating rays, and the reading of the stimulated emission is made from the same upper side.

The phosphor sheet composite was coated with a support on one surface and with a protective layer on another surface in the same manner as in Example 1, to prepare a radiation image storage panel according to the invention.

EXAMPLE 3

Two Phosphor sheets B (two non-colored stimulable phosphor sheets) were prepared in the same manner as in Example 1.

One Phosphor sheet C' (colored stimulable phosphor sheet) having a thickness of not 120 μm but 60 μm was further prepared.

One Phosphor sheet B was turned upside down, and Phosphor sheet C' having been beforehand turned upside down was laminated thereon. On the laminated Phosphor sheet C', another Phosphor sheet B was placed.

Figure 3:
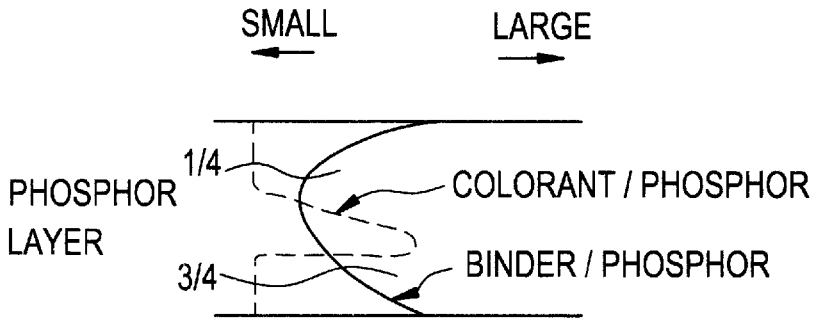
FIG. 3 shows a schematic view of distributions of the binder-to-phosphor particles ratio by weight and the colorant-to-phosphor particles ratio by weight in the radiation image storage panel of the invention which is prepared in Example 3.

The resulting laminate of Phosphor sheet B—Phosphor sheet C' (turned upside down)—Phosphor sheet B (turned upside down) from the upper side was compressed under heating in the same manner as in Example 1 to give a phosphor sheet composite. The composite was cut to observe its section by an optical microscope in the same manner as in Example 1. It was confirmed that the components were distributed in the manner as schematically illustrated in FIG. 3. In FIG. 3, the upper side is to receive application of stimulating rays, and the reading of the stimulated emission is made from the same upper side.

The phosphor sheet composite was coated with a support on one surface and with a protective layer on another surface in the same manner as in Example 1, to prepare a radiation image storage panel according to the invention.

COMPARISON EXAMPLE 1

A coating dispersion for preparing a colored stimulable phosphor sheet was prepared in the same manner as in Example 1 except for employing 300 g of the stimulable phosphor particles and 150 mg of the colorant. The obtained dispersion was coated on a temporary support and dried in the same manner as in Example 1 to give a stimulable phosphor layer having a thickness of 80 μm on the support. The phosphor layer was then separated from the support to give a colored stimulable phosphor sheet. In the same manner, two colored stimulable phosphor sheets of 120 μm and 140 μm, respectively, were prepared.

Figure 4:
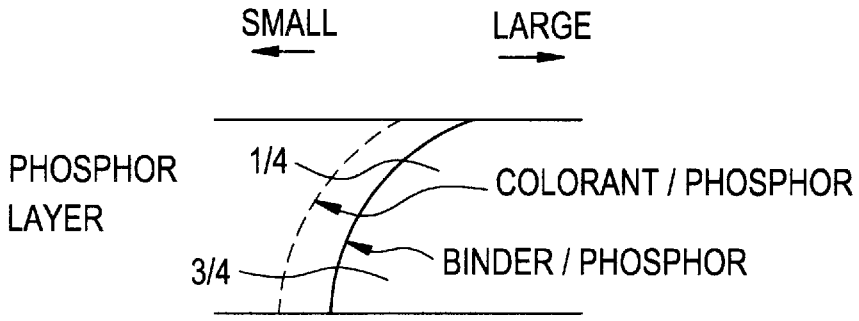
FIG. 4 shows a schematic view of distributions of the binder-to-phosphor particles ratio by weight and the colorant-to-phosphor particles ratio by weight in the radiation image storage panel of the invention which is prepared in each of Comparison Examples 1 and 2.

Each of the resulting three phosphor sheets was cut to observe its section by an optical microscope in the same manner as in Example 1. It was confirmed that the components were distributed in the manner as schematically illustrated in FIG. 4 in all of the phosphor sheets. In FIG. 4, the upper side is to receive application of stimulating rays, and the reading of the stimulated emission is made from the same upper side.

Each of the phosphor sheets was coated with a support on one surface and with a protective layer on another surface in the same manner as in Example 1, to prepare three radiation image storage panels for comparison.

COMPARISON EXAMPLE 2

A coating dispersion for preparing a colored stimulable phosphor sheet was prepared in the same manner as in Example 1 except for employing 400 g of the stimulable phosphor particles and 200 mg of the colorant. The obtained dispersion was coated on a temporary support and dried in the same manner as in Example 1 to give a stimulable phosphor layer having a thickness of 100 μm on the support. The phosphor layer was then separated from the support to give a colored stimulable phosphor sheet. In the same manner, two colored stimulable phosphor sheets of 150 μm and 200 μm, respectively, were prepared.

Each of the resulting three phosphor sheets was cut to observe its section by an optical microscope in the same manner as in Example 1. It was confirmed that the components were distributed in the manner as schematically illustrated in FIG. 4 in all of the phosphor sheets. In FIG. 4, the upper side is to receive application of stimulating rays, and the reading of the stimulated emission is made from the same upper side.

Each of the phosphor sheets was coated with a support on one surface and with a perspective layer on another surface in the same manner as in Example 1, to prepare three radiation image storage panels for comparison.

COMPARISON EXAMPLE 3

(1) Two Phosphor sheets A' (two colored stimulable phosphor sheets) were prepared in the same manner as in Example 1, except for changing the thickness to 60 μm.

One Phosphor sheet A' was turned upside down, and Another Phosphor Sheet A' was laminated thereon.

Figure 5:
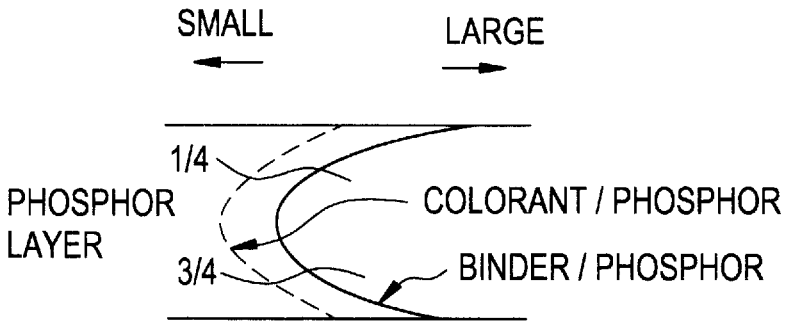
FIG. 5 shows a schematic view of distributions of the binder-to-phosphor particles ratio by weight and the colorant-to-phosphor particles ratio by weight in the radiation image storage panel of the invention which is prepared in Comparison Example 3.

The resulting laminate of Phosphor sheet A' (turned upside down)—Phosphor sheet A' from the upper side was compressed under heating in the same manner as in Example 1 to give a phosphor sheet composite. The composite was cut to observe its section by an optical microscope in the same manner as in Example 1. It was confirmed that the components were distributed in the manner as schematically illustrated in FIG. 5. In FIG. 5, the upper side is to receive application of stimulating rays, and the reading of the stimulated emission is made from the same upper side.

The phosphor sheet composite was coated with a support on one surface and with a protective layer on another surface in the same manner as in Example 1, to prepare a radiation image storage panel for comparison.

(2) Two Phosphor sheets A" (two colored stimulable phosphor sheets) were prepared in the same manner as in Example 1, except for changing the thickness to 85 μm.

One Phosphor sheet A" was turned upside down, and Another Phosphor sheet A" was laminated thereon.

The resulting laminate of Phosphor sheet A" (turned upside down)—Phosphor sheet A" from the upper side was compressed under heating in the same manner as in Example 1 to give a phosphor sheet composite. The composite was cut to observe its section by an optical microscope in the same manner as in Example 1. It was confirmed that the components were distributed in the manner as schematically illustrated in FIG. 5. In FIG. 5, the upper side is to receive application of stimulating rays, and the reading of the stimulated emission is made from the same upper side.

The phosphor sheet composite was coated with a support on one surface and with a protective layer on another surface in the same manner as in Example 1, to prepare another radiation image storage panel for comparison.

COMPARISON EXAMPLE 4

Phosphor sheets A'" (colored stimulable phosphor sheets) was prepared in the same manner as in Example 1, except for changing the thickness to 180 μm.

On the prepared Phosphor sheet A'" was laminated Phosphor sheet B (non-colored stimulable phosphor sheet, which was prepared in the same manner as in Example 1) having been beforehand turned upside down.

Figure 6:
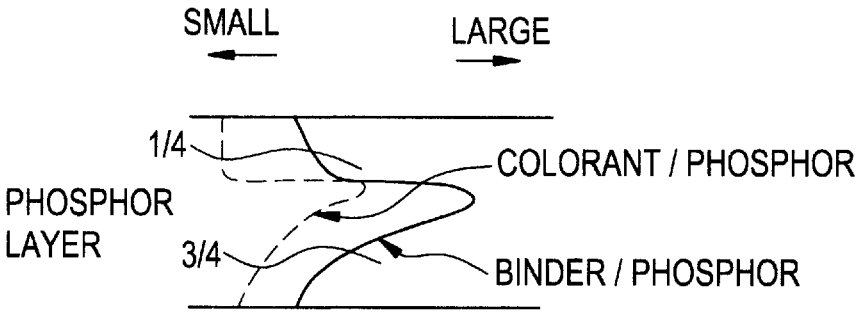
FIG. 6 shows a schematic view of distributions of the binder-to-phosphor particles ratio by weight and the colorant-to-phosphor particles ratio by weight in the radiation image storage panel of the invention which is prepared in Comparison Example 4.

The resulting laminate of Phosphor sheet A'"—Phosphor sheet B (turned upside down) from the upper side was compressed under heating in the same manner as in Example 1 to give a phosphor sheet composite. The composite was out to observe its section by an optical microscope in the same manner as in Example 1. It was confirmed that the components were distributed in the manner as schematically illustrated in FIG. 6. In FIG. 6, the upper side is to receive application of stimulating rays, and the reading of the stimulated emission is made from the same upper side.

The phosphor sheet composite was coated with a support on one surface and with a protective layer on another surface in the same manner as in Example 1, to prepare another radiation image storage panel for comparison.

EVALUATION OF RADIATION IMAGE STORAGE PANEL

The sensitivity and sharpness were measured on each of the radiation image storage panels of Examples 1–3 and Comparison Examples 1–4 in the manner set forth below. The measured luminance value was converted into a relative value and illustrated graphically in FIG. 7 to indicate a relationship with the corresponding sharpness by the position in the growth.

(1) Measurement of sensitivity

The radiation image storage panel was exposed to X-rays at 80 KVp, and then was stimulated with He-Ne laser light (wavelength: 632.8 nm) to determine luminance of stimulated emission.

(2) Measurement of sharpness

The radiation image storage panel was exposed to X-rays at 80 KVp through the MTF measurement pattern, and then was stimulated with He-Ne laser (wavelength: 632.8 nm). The stimulated emission was collected and converted into a set of electric signals. The electric signals were processed to reproduce a radiation image on a display. Then, the modulation transfer function (MTF) was measured.

Figure 7:
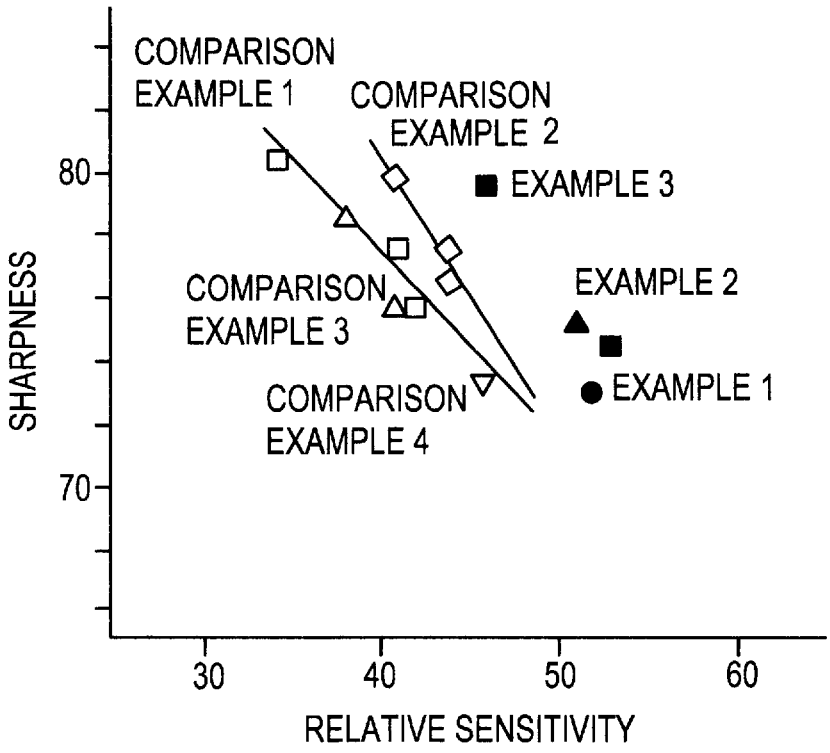
FIG. 7 is a graph showing relationships between sensitivity and sharpness observed in the radiation image storage panels prepared in Examples 1–3 and Comparison Examples 1–4.

The results illustrated graphically in FIG. 7 teach that the radiation image storage panels of the invention give radiation images of higher sharpness, as compared with the known radiation image storage panel on the same sensitivity levels. These results suggest advantageous nature of the radiation image storage panel according to the invention specifically in the use for mammography. The radiation image storage panels of the invention are also advantageous in the use for other radiography requiring reproduction of a radiation image of higher sharpness.

What I claim is:

1. A radiation image storage panel having a surface which receives the application of stimulating rays and from which stimulated emission is read, said radiation image storage panel comprising a stimulable phosphor layer which comprises stimulable phosphor particles and a binder and is colored with a colorant so as to absorb a portion of said stimulating rays, wherein a weight ratio of binder to phosphor particles and concentration of coloring are varied along the depth of the phosphor layer in such manner that a mean value of a weight ratio of binder to phosphor particles within ¼ of the depth of the phosphor layer from said stimulating ray-receiving surface thereof is larger than a mean value of a weight ratio of binder to phosphor particles between ¼ and ¾ of the depth of the phosphor layer from said surface, and a mean value of a weight ratio of colorant to phosphor particles within ¼ of the depth of the phosphor layer from said surface is smaller than a mean value of the weight ratio of colorant to phosphor particles between ¼ and 4/4 of the depth of the phosphor layer from said surface.

2. The radiation image storage panel of claim 1, wherein the weight ratio of binder to phosphor particles has a minimum value in an area between ¼ and 4/4 of the depth of the phosphor layer from the surface.

3. The radiation image storage panel of claim 1, wherein the weight ratio of colorant to phosphor particles has the maximum value in the area between ¼ and 4/4 of the depth of the phosphor layer from the surface.

* * * * *